US009689390B2

(12) United States Patent
Moss et al.

(10) Patent No.: US 9,689,390 B2
(45) Date of Patent: Jun. 27, 2017

(54) FLUID PUMP WITH SHAFT DRIVEN PUMPING ELEMENT

(71) Applicant: TI Group Automotive Systems, L.L.C., Auburn Hills, MI (US)

(72) Inventors: Glenn A. Moss, Cass City, MI (US); Edward J. Talaski, Caro, MI (US)

(73) Assignee: TI Group Automotive Systems, L.L.C., Auburn Hills, MI (US)

( * ) Notice: Subject to any disclaimer, the term of this patent is extended or adjusted under 35 U.S.C. 154(b) by 361 days.

(21) Appl. No.: 14/187,482

(22) Filed: Feb. 24, 2014

(65) Prior Publication Data

US 2014/0241861 A1 Aug. 28, 2014

Related U.S. Application Data

(60) Provisional application No. 61/768,988, filed on Feb. 25, 2013.

(51) Int. Cl.
*F04C 29/00* (2006.01)
*F04D 29/053* (2006.01)
(Continued)

(52) U.S. Cl.
CPC ..... *F04C 29/005* (2013.01); *F04C 15/0073* (2013.01); *F04D 29/053* (2013.01); *F04C 2/102* (2013.01)

(58) Field of Classification Search
CPC ... F04C 15/0073; F04C 29/005; F04D 29/053
See application file for complete search history.

(56) References Cited

U.S. PATENT DOCUMENTS 3,208,392 A * 9/1965 Garrison ..... F04C 14/04 418/171
4,592,733 A * 6/1986 Bland ..... F04C 15/0073 418/154
(Continued)

FOREIGN PATENT DOCUMENTS

DE EP 2354525 A1 * 8/2011 ..... F04C 15/0073
DE 102011089083 A1 6/2013
(Continued)

OTHER PUBLICATIONS

Extended European Search Report for EP Application No. 14156619.0 dated Apr. 24, 2014 (8 pages).

*Primary Examiner* — Mary A Davis
(74) *Attorney, Agent, or Firm* — Brinks Gilson & Lione

(57) ABSTRACT

In at least some implementations, a fluid pump includes a drive shaft including at least one drive surface and a pumping element. The pumping element includes an opening in which a portion of the drive shaft is received so that the pumping element is driven for rotation by the drive shaft, and the opening is larger than the drive shaft to provide a clearance between the pumping element and at least part of the drive shaft. The pumping element also includes at least one engagement surface arranged to be engaged by the drive surface of the drive shaft when the drive shaft is rotated where one or both of the drive surface and the engagement surface are angled to provide a surface area of engagement between the drive surface and engagement surface that is at least 1% of the surface area of the drive surface.

11 Claims, 2 Drawing Sheets

(51) Int. Cl.
*F04C 15/00* (2006.01)
*F04C 2/10* (2006.01)

(56) References Cited

U.S. PATENT DOCUMENTS 5,588,819 A * 12/1996 Wallis ..... F04C 29/0057
418/39
6,648,619 B2 * 11/2003 Otto ..... F04C 29/005
418/152

FOREIGN PATENT DOCUMENTS

EP 1837522 A1 9/2007
GB 2430012 3/2007
JP 2004332754 11/2004
JP WO 2006075364 A1 * 7/2006 ..... F04C 2/084

* cited by examiner

FLUID PUMP WITH SHAFT DRIVEN PUMPING ELEMENT

REFERENCE TO CO-PENDING APPLICATION

This application claims the benefit of U.S. Provisional Application No. 61/768,988 filed Feb. 25, 2013, which is incorporated herein by reference in its entirety.

TECHNICAL FIELD

The present disclosure relates generally to a fluid pump including a motor and a pumping element driven by the motor.

BACKGROUND

Some electric motor driven liquid pumps include a pumping element driven by a shaft that is rotated by the motor. The pumping element may be an impeller or meshed gears and has a component engaged and driven for rotation by the shaft. Engagement of the shaft with the pumping element can cause wear of one or both components and the interaction between these components can change over time due at least in part to such wear.

SUMMARY

In at least some implementations, a fluid pump includes a drive shaft driven for rotation and including at least one drive surface and a pumping element. The pumping element includes an opening in which a portion of the drive shaft is received so that the pumping element is driven for rotation by the drive shaft, and the opening is larger than the drive shaft to provide a clearance between the pumping element and at least part of the drive shaft. The pumping element also includes at least one engagement surface arranged to be engaged by the drive surface of the drive shaft when the drive shaft is rotated where one or both of the drive surface and the engagement surface are angled to provide a surface area of engagement between the drive surface and engagement surface that is at least 1% of the surface area of the drive surface. This may provide more than a point or thin line of contact between the drive shaft and the pumping element to, for example, reduce or improve wear characteristics in use.

In at least some implementations, a fluid pump includes a drive shaft driven for rotation and including at least one drive surface and a pumping element. The pumping element includes an opening in which a portion of the drive shaft is received so that the pumping element is driven for rotation by the drive shaft, and the opening is larger than the drive shaft to provide a clearance between the pumping element and at least part of the drive shaft. The pumping element also includes at least one engagement surface arranged to be engaged by the drive surface of the drive shaft when the drive shaft is rotated. And one or both of the drive surface and the engagement surface are oriented at an angle of between 1 and 45 degrees relative to a tangent extending through an end of the drive surface.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
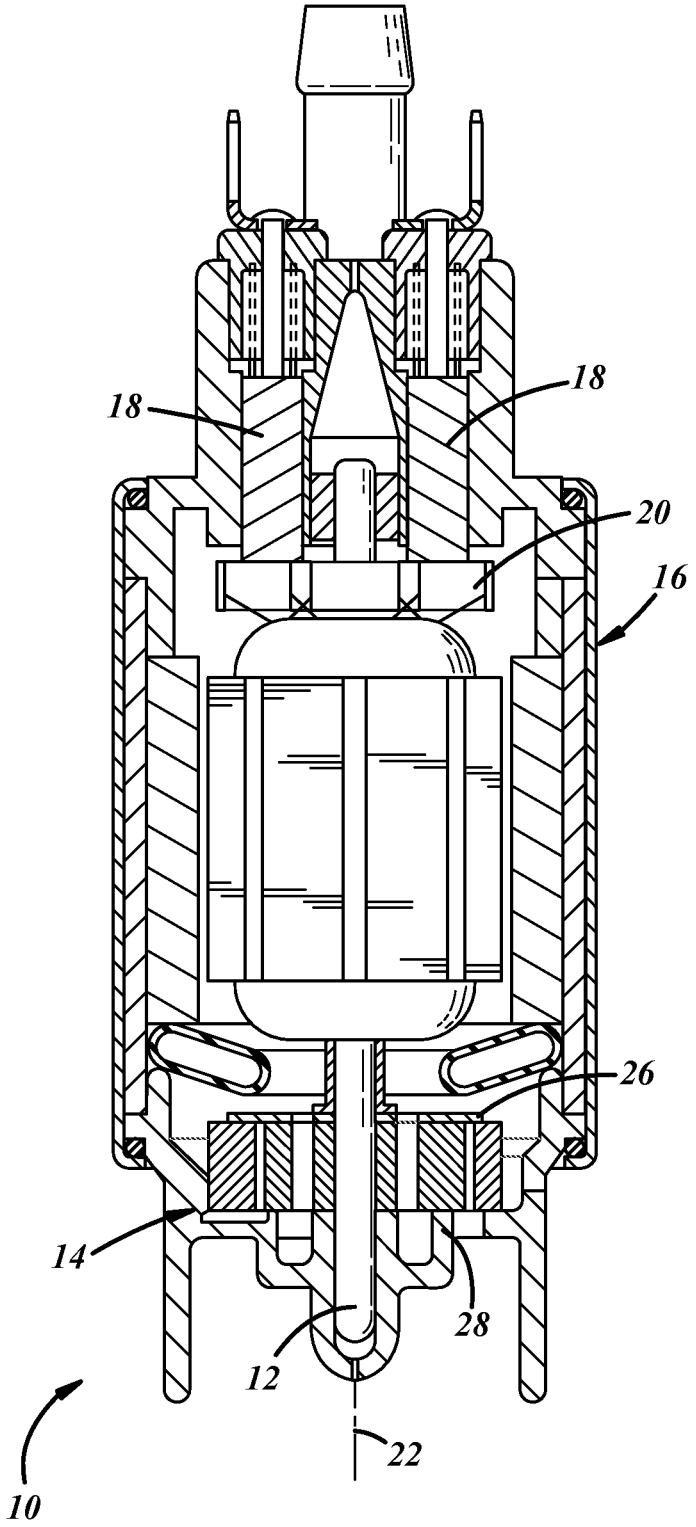
FIG. 1 is a side sectional view of a fluid pump including a motor driven drive shaft and a pumping element.
Figure 2:
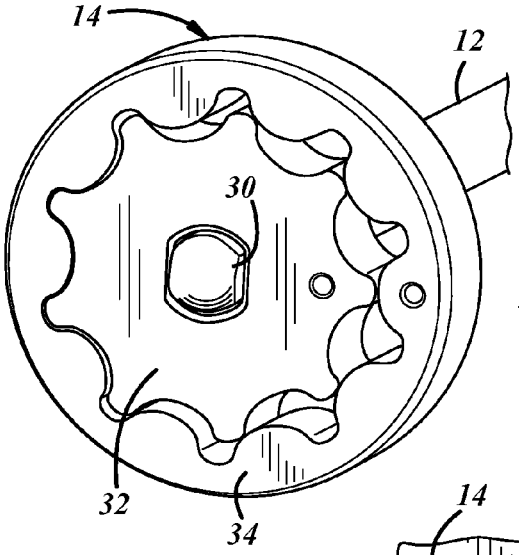
FIG. 2 is a perspective view of the drive shaft and pumping element.
Figure 3:
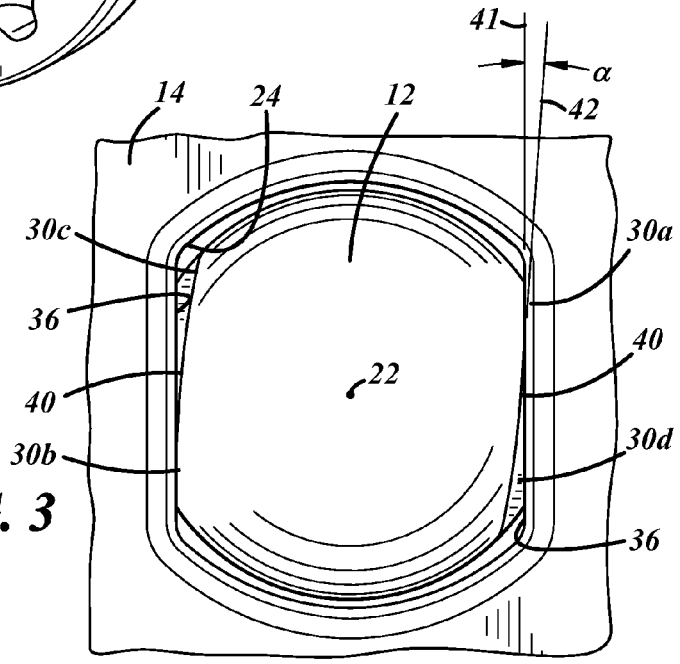
FIG. 3 is an enlarged fragmentary end view illustrating the drive shaft within an opening in the pumping element, shown here as an inner gear of a gerotor gear set.

Referring in more detail to the drawings, FIGS. 1-3 illustrate a fluid pump 10 with a drive shaft 12 and a pumping element 14 driven for rotation by the drive shaft 12. The drive shaft 12, in turn, may be driven by a motor, such as an electric motor 16. The fluid pump 10 may be used to pump liquids, such as fuel used to power an engine that, for example, may be used in an automobile or other vehicle. While the remainder of the description herein will focus on the pump as a fuel pump, the pump may be used in other applications.

The motor 16 may be any suitable device that rotates the drive shaft 12. The motor 16 may include brushes 18 acting on a commutator 20, or it may be a brushless motor, as desired. Such motor arrangements are known in the art and will not be further discussed herein. The motor 16 drives the shaft 12 for rotation about an axis 22 of rotation in one or both directions (i.e. clockwise and/or counterclockwise). And the drive shaft 12 rotates the pumping element 14 to generate a pumping action that moves fluid into and out of the pump 10. The pumping element 14 may include an impeller (in a so-called turbine pump), a gerotor gear set, or be of another construction. In the implementations shown, the pumping element 14 includes an opening 24 in which a portion of the drive shaft 12 is received, and the pumping element 14 is received between two pump bodies 26, 28 that, with the pumping element, define fuel pumping areas or channels into and through which fuel is pumped. To permit the pumping element 14 to self-align with and not bind between the pump bodies 26, 28 or on the drive shaft 12, some clearance is provided between the drive shaft 12 and the pumping element 14 that is directly driven by the drive shaft. This permits some relative movement between the pumping element 14 and the drive shaft 12 and accommodates manufacturing tolerances of the various components.

Figure 4:
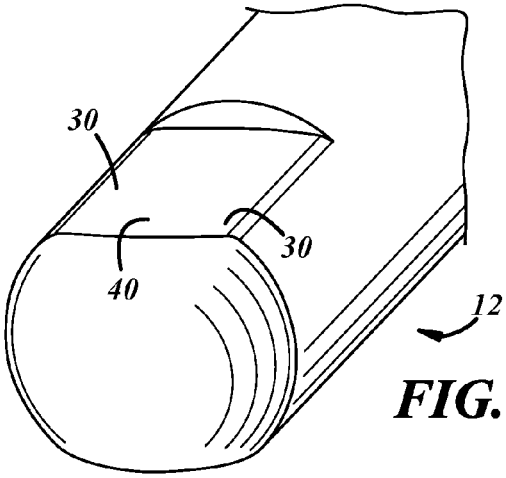
FIG. 4 is an enlarged partial perspective view of the drive shaft illustrating one or more contact surfaces formed on the drive shaft.

To facilitate rotation of the pumping element 14, as shown in FIGS. 2-4, the drive shaft 12 may have one or more drive features 30 formed on or along a portion of its length, in the area of engagement with the pumping element 14. In the implementation shown, the drive shaft 12 is a right cylindrical solid metal shaft, and the drive features 30 include one or more flat surfaces formed or otherwise provided on the shaft. Of course, the drive shaft 12 could have other shapes, need not be solid, and could be formed from other materials. And the drive features 30 need not be planar and can instead have any shape that permits the desired rotational engagement with the drive shaft 12.

As noted above, the pumping element 14 includes the opening 24 into which a portion of the drive shaft 12 is received to drivingly couple these components together. In the implementation shown wherein the pumping element 14 includes a gerotor gear seat, the opening 24 is provided in an inner gear 32 that is received within an outer ring gear 34. The inner and outer gears 32, 34 have meshed teeth such that rotation of the inner gear 32 drives the outer gear 34 and creates between the gears pumping chambers that become larger and smaller as the gears rotate, to pump fuel. The opening 24 in the inner gear 32 includes or is defined at least in part by engagement surfaces 36 adapted to be engaged by the drive features 30 of the drive shaft 12. The remainder of the opening 24 may be any shape and size providing desired clearance between the shaft 12 and inner gear 32 (or other pumping element 14 driven by the shaft 12). In the implementation shown, the opening 24 includes two opposed flat surfaces 36 that are interconnected by two opposed arcuate surfaces. The shape of the arcuate surfaces may be complementary to the shape of the drive shaft 12 outside of the areas of the shaft including the drive features 30. In the implementation shown, the shaft 12 has a circular exterior except for the area including the drive features 30 and the arcuate surfaces of the opening 24 may likewise be portions of a circle with a diameter larger than the nominal diameter of the shaft 12 to provide clearance between them.

In the implementation shown, multiple drive features 30 are provided on opposite sides of the periphery or exterior of the drive shaft 12. In more detail, four drive surfaces 30 are provided, with one generally diametrically opposed pair 30*a, b* adapted to contact corresponding engagement surfaces 36 of the pumping element 14 and another generally diametrically opposed pair 30*c, d* adapted to contact corresponding engagement surfaces 36 of the pumping element 14. The drive surfaces 30*a, b* of one pair are adapted to engage the pumping element 14 when the drive shaft 12 is rotated in a first direction and the drive surfaces 30*c, d* of the other pair are adapted to engage the pumping element 14 when the drive shaft 12 is rotated in a second direction. One side of the shaft 12 includes one of each pair of drive surfaces 30, and an intermediate surface 40 extending between the drive surfaces 30 on that side of the shaft 12. While the intermediate surface 40 is shown as a flat surface, it could be a line (straight or not), arcuate, or otherwise formed. In this implementation, the intermediate surface 40 is not designed to contact the pumping element 14 during driving engagement of the shaft 12 and pumping element 14. In other implementations, different number of drive features 30 (e.g. surfaces) may be used including, for example, only one drive surface 30 or one opposed pair of drive surfaces 30.

In the implementation shown, the drive surfaces 30 are arranged so that they are not at a constant radius from the axis 22 of the drive shaft 12. In this implementation, the drive surfaces 30 are defined by flat, generally planar portions of the drive shaft 12 that are angled so that when the drive shaft is rotated relative to the pumping element 14, the drive surfaces 30 provide a surface area of contact with the pumping element 14 rather than a thin line of contact. In at least some implementations, the surface area of contact between a drive surface 30 and engagement surface 36 may be between 1% and 100% of the surface area of the drive surface 30, with at least some implementations including a surface area of contact of at least 10-50% of the drive surface. In at least some implementations, the surface area of contact may be between 0.3 $mm^2$ and 3 $mm^2$, of course, the actual area in an application will vary as the thickness of the pumping element and size of the shaft vary. When two opposed driving surfaces (e.g. 30*a, b*) are provided, the total surface area of contact between the drive shaft 12 and pumping element 14 may then be between 0.6 $mm^2$ and 6 $mm^2$ The angle $\alpha$ at which the drive surfaces 30 are disposed may be a function of the clearance provided between the drive shaft 12 and pumping element 14 within the opening 24. The greater the clearance, the greater the angle of the drive surfaces 30 to provide the desired surface area of contact, where the angle of the drive surfaces 30 is measured relative to a line 42 tangent to a point at the start or end of a drive surface 30. In the implementation shown, the drive surfaces 30 (represented by line 41 in FIG. 3) may be oriented at an angle of between 1 and 45 degrees relative to the tangent line 42, and the drive surfaces 30 are not parallel to each other (that is, they are oriented at different angles relative to the axis of the drive shaft 12). In at least some implementations, the clearance between the pumping element 14 and the drive shaft 12 may permit the drive shaft to rotate relative to the pumping element 14 between about 1 and 45 degrees and thereafter the drive shaft 12 will be drivingly engaged with the pumping element. In at least certain presently preferred implementations, each surface in a pair of driving surfaces 30*a, b* or 30*c, d* is oriented at the same angle providing a symmetrical engagement in either direction of rotation.

The angle of the driving surfaces 30 may be chosen based on a nominal designed clearance between the pumping element 14 and drive shaft 12. However, the relative size and spacing of these components will vary within manufacturing tolerances of these and surrounding components. Accordingly, the initial surface area of contact may be less than desired in some pumps. In that case, the drive surface(s) 30 and/or engagement surface(s) 36 may wear to provide a suitable surface area of engagement. Such wear would be far less than the wear that may occur in a drive shaft arranged for line contact with the pumping element.

While the opening 24 and shaft 12 are shown with generally diametrically opposed pairs of drive features 30 and engagement surfaces 36, only one drive feature (e.g. 30*a*) and corresponding engagement surface is needed. Also, while the above description was directed to the drive surfaces 30 being at a particular angle, the engagement surfaces 36 could instead or also be angled to provide a desired surface area of contact between the shaft 12 and pumping element 14 when they are driving engaged. Stated differently, the drive surface 30 and corresponding engagement surface 36 are arranged to accommodate the relative rotation between the drive shaft 12 and pumping element 14 that occurs because of the clearance provided between these components so that a desired surface area of contact is provided between these surfaces when the drive shaft 12 is driving the pumping element 14 for rotation. Also, while the drive surface(s) 30 and engagement surface(s) 36 are shown as being flat or planar, they could be curved or of irregular shape to provide the desired surface area of engagement. As one example, the surfaces could be a part of an oval, or a circle having a diameter different than that of the nominal shaft diameter (i.e. the shaft diameter without the drive surfaces).

Because the pumping element 14 is not fixed to the drive shaft 12, and due to the clearance between the pumping element 14 and drive shaft 12, there can be an impact force transmitted between these components when the drive shaft 12 is initially rotated. In some motor applications, such as at least some brushless motors, the drive shaft 12 may initially rotate in both directions before being driven in a desired direction such that the initial impact may occur in opposed directions and at spaced locations between the pumping element 14 and drive shaft 12. Also, during operation of the fluid pump 10, there can be relative motion between the drive shaft 12 and pumping element 14 which can cause wear of one or both components, especially if there is an insufficient area of contact between them (e.g. contact at a point or line). The matched or complementary drive and engagement surfaces 30, 36 on the drive shaft 12 and pumping element 14 can provide a desired or large enough surface area of engagement to reduce or prevent noticeable wear to these components, over a relatively wide range of manufacturing tolerances. This may increase the durability and life expectancy of the pump 10, reduce warranty costs, improve performance and/or permit use of less strong or durable components which may be lighter and/or less expensive to manufacture (e.g. thinner and/or different material).

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A fluid pump, comprising:

a drive shaft driven for rotation and including at least two drive surfaces formed on or along a portion of the length of the drive shaft;

a pumping element including an opening in which the at least two drive surfaces are received so that the pumping element is driven for rotation by the drive shaft, the opening being larger than the drive shaft to provide a clearance between the pumping element and the at least two drive surfaces, and the pumping element also including at least two engagement surfaces arranged to be engaged by the respective at least two drive surfaces of the drive shaft when the drive shaft is rotated where one or both of the at least two drive surfaces and the at least two engagement surfaces are angled between 1 and 45 degrees relative to a tangent extending through a point on the drive shaft at which the respective at least two drive surfaces starts or ends in order to provide a surface area of engagement between the at least two drive surfaces and the respective at least two engagement surfaces that is between 10% and 50% of the surface area of the respective at least two drive surfaces;

wherein when the drive shaft rotates in two directions, two drive surfaces of the at least two drive surfaces are provided, which are not parallel to each other, one drive surface is adapted to engage the pumping element when the drive shaft rotates in one direction and the other drive surface is adapted to engage the pumping element when the drive shaft rotates in the other direction.

2. The fluid pump of claim 1 wherein the surface area of engagement between each of the at least two drive surfaces and the respective at least two engagement surfaces is between 0.3 $mm^2$ and 3 $mm^2$.

3. The fluid pump of claim 1 wherein the drive shaft includes an intermediate surface adjacent to the at least two drive surfaces.

4. The fluid pump of claim 1 wherein the at least two drive surfaces comprises of four drive surfaces, where a pair of drive surfaces of the four drive surfaces are diametrically opposed to each other and adapted to engage the pumping element when the drive shaft rotates in one direction.

5. The fluid pump of claim 1 wherein the at least two engagement surfaces are angled to provide the surface area of engagement between the at least two drive surfaces and the respective at least two engagement surfaces.

6. The fluid pump of claim 1 wherein the at least two drive surfaces are defined by a flat portion of the drive shaft.

7. The fluid pump of claim 1 wherein the at least two drive surface are symmetrically oriented relative to an axis of the drive shaft to provide a symmetrical engagement between one of the at least two drive surface and the pumping element in either direction of rotation.

8. The fluid pump of claim 1 wherein the at least two drive surfaces are arranged so that they are not at a constant radius from an axis of rotation of the drive shaft.

9. The fluid pump of claim 1 wherein a clearance is provided between the pumping element and the drive shaft that permits the drive shaft to rotate relative to the pumping element between 1 and 45 degrees and thereafter the drive shaft will be drivingly engaged with the pumping element, and the angle of orientation of one or both of the at least two drive surfaces and the respective at least two engagement surfaces are chosen as a function of the permitted relative rotation of the drive shaft relative to the pumping element.

10. The fluid pump of claim 1 wherein the drive shaft includes an intermediate surface located between the at least two drive surface and oriented at angle to and not parallel with the at least two drive surfaces.

11. The fluid pump of claim 10 wherein the at least two drive surfaces are arranged so that they are not at a constant radius from an axis of rotation of the drive shaft.

* * * * *